US006880504B2

(12) United States Patent
Takahashi

(10) Patent No.: US 6,880,504 B2
(45) Date of Patent: Apr. 19, 2005

(54) VALVE TIMING CONTROL APPARATUS FOR INTERNAL COMBUSTION ENGINE

(75) Inventor: Tatsuhiko Takahashi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/310,816

(22) Filed: Dec. 6, 2002

(65) Prior Publication Data

US 2004/0011311 A1 Jan. 22, 2004

(30) Foreign Application Priority Data

Jul. 16, 2002 (JP) ..... 2002-206909

(51) Int. Cl.[7] ..... F01L 1/34
(52) U.S. Cl. ..... 123/90.15; 123/90.17
(58) Field of Search ..... 123/90.15, 90.17, 123/90.31, 90.16

(56) References Cited

U.S. PATENT DOCUMENTS 5,462,022 A * 10/1995 Ushida ..... 123/90.17
6,301,543 B1 * 10/2001 Fujiwara et al. ..... 701/114
6,405,697 B1 * 6/2002 Mikame ..... 123/90.18

FOREIGN PATENT DOCUMENTS

JP 6-299876 10/1994
JP 2000-345868 A 12/2000
JP 2002-130038 A 5/2002

* cited by examiner

*Primary Examiner*—Thomas Denion
*Assistant Examiner*—Zelalem Eshete
(74) *Attorney, Agent, or Firm*—Sughrue Mion, PLLC

(57) ABSTRACT

A valve timing control apparatus for an internal combustion engine can be improved in accuracy in the detection of valve timing (cam angles). A crank angle sensor generates a crank angle signal in the form of a train of pulses. Cam angle changing parts change phases of camshafts relative to a crankshaft. Cam angle sensors generate cam angle signals. A reference crank angle detection part detects reference crank angles based on the crank angle signal. Cam angle calculation parts calculate the cam angles of the camshafts based on the crank angle signal and the cam angle signals. A cam angle control part controls the relative phases of the camshafts to the crankshaft so as make them coincide with target cam angles corresponding to operating conditions of the engine. A cam angle calculation part calculates the cam angles by counting the number of pulses of the crank angle signal.

12 Claims, 11 Drawing Sheets

| CRANK ANGLE [degCA] | | TIME [ms] |
|---|---|---|
| 65 | B75 ~ B65 | 0.923 |
| 55 | B65 ~ B55 | 0.950 |
| 45 | B55 ~ B45 | 0.983 |
| 35 | B45 ~ B35 | 1.017 |
| 25 | B35 ~ B25 | 1.050 |
| 15 | B25 ~ B15 | 1.077 |
| 5 | B15 ~ B05 | 1.094 |
| 175 | B05 ~ B175 | 1.100 |
| 165 | B175 ~ B165 | 1.094 |
| 155 | B165 ~ B155 | 1.077 |
| 145 | B155 ~ B145 | 1.050 |
| 135 | B145 ~ B135 | 1.017 |
| 125 | B135 ~ B125 | 0.983 |
| 115 | B125 ~ B115 | 0.950 |
| 105 | B115 ~ B105 | 0.923 |
| 95 | B105 ~ B95 | 0.906 |
| 85 | B95 ~ B85 | 0.900 |
| 75 | B85 ~ B75 | 0.906 |

VALVE TIMING CONTROL APPARATUS FOR INTERNAL COMBUSTION ENGINE

BACKGROUND OF THE INVENTION

1. Field of the Invention

The present invention relates to an apparatus for controlling the relative phase of a camshaft (cam angle) to a crankshaft in accordance with the operating conditions of an internal combustion engine thereby to control the valve operation (opening and/or closing) timing of an intake valve and an exhaust valve. More particularly, it relates to a valve timing control apparatus for an internal combustion engine that serves to prevent deteriorations in driveability, fuel consumption and exhaust emissions by reducing errors in the calculation of a cam angle based on a crank angle signal and a cam angle signal.

2. Description of the Related Art

Recently, in internal combustion engines (hereinafter also simply referred to as an engine) installed on motor vehicles or the like, regulation of harmful substances contained in the exhaust emissions discharged from the engines to the atmosphere is becoming severe from consideration of the environment, and hence it is demanded to reduce the harmful substances in the exhaust emissions.

In general, in order to reduce the harmful exhaust emissions, there have been known two methods, one of which is a method of reducing harmful gases exhausted directly from engines, and the other method is to postprocess the harmful exhaust emissions with a catalytic converter (hereinafter simply referred to as a "catalyst") arranged on an exhaust pipe, Since reactions for making the harmful gases harmless do not take place in this kind of catalyst until a certain temperature is reached, as is well-known, for instance, it is important that the temperature of the catalyst is raised to its activation temperature early or quickly even at the cold starting of the engine.

Today, in order to improve engine power or reduce exhaust emissions and fuel consumption, there have been adopted valve timing control apparatuses capable of changing the intake and exhaust valve opening and closing timings for each cylinder according to engine operating conditions.

In this kind of conventional apparatuses, variable means (actuators) for changing the relative positions of camshafts to a crankshaft of an engine are installed, and the crank angle position (i.e., the rotational position of the crankshaft) and the relative phases of the camshafts with respect to the crankshaft are detected with the reference position of the variable means being stored in memory, so that the relative phases of the camshafts are controlled in accordance with the engine operating conditions.

In the past, this type of valve timing control apparatus has been shown in Japanese Patent Application Laid-Open No. Hei 6-299876 for instance.

In the conventional apparatus disclosed in the above document, a cam angle changing means comprising an oil control valve (OCV) and an actuator is mounted on at least one of an intake camshaft and an exhaust camshaft so that a relative phase difference between the crank angle and the cam angle is learned at the time when the cam angle changing means is out of operation.

However, note that a crank angle sensor in the above-mentioned conventional apparatus generates, as a crank angle signal, only one pulse (corresponding to a crank angle position as a control reference) within a control stroke (i.e., intake, compression, explosion or exhaust stroke) for each cylinder of an internal combustion engine, and the relative phase of the cam angle to the crank angle is detected based on the crank angle signal and the cam angle signal.

In cases where the crank angle signal including one pulse per stroke is used, however, it is necessary to measure the periods of time between successive pulses of the crank angle signal so as to calculate the cam angle.

In addition, even in cases where the crank angle signal including two or more pulses per stroke is used, it is similarly necessary to measure the periods of time between successive pulses of the crank angle signal in order to detect the cam angle.

FIG. 8 is a block diagram in which a valve timing control apparatus of the general type for an internal combustion engine is shown in relation to peripheral parts of an engine 1.

In FIG. 8, air is supplied from an intake pipe 4 to the engine 1 through an air cleaner 2 and an airflow sensor 3.

The air cleaner 2 cleans the air to be sucked to the engine 1, and the airflow sensor 3 measures the amount of intake air supplied to the engine 1.

In the intake pipe 4, there are arranged a throttle valve 5, an idle speed control valve (hereinafter called "ISCV") 6 and an injector 7.

The throttle valve 5 adjusts the amount of intake air passing through the intake pipe 4 to control the output power of the engine 1, and the ISCV 6 adjusts the intake air bypassing the throttle valve 5 so as to control the rotational speed or the number of revolutions per minute of the engine 1.

The injector 7 supplies an amount of fuel corresponding to the amount of intake air to the intake pipe 4.

A spark plug 8 is arranged in a combustion chamber of each cylinder of the engine 1 for generating a spark to fire an air fuel mixture within the combustion chamber.

A plurality of ignition coils 9 (though only one of them being illustrated) supply high voltage energy to corresponding spark plugs 8.

The exhaust pipe 10 discharges exhaust gas that is resulted from the combustion of the air fuel mixture in each combustion chamber of the engine 1.

In the exhaust pipe 10, there are arranged an oxygen sensor 11 for detecting the amount of residual oxygen in the exhaust gas and a catalytic converter 12.

The catalytic converter 12 contains therein a catalyst comprising a well-known three-way catalyst which is able to purify harmful gas components (THC, CO, NOx) in the exhaust gas at the same time.

A crank angle detection sensor plate 13 is caused to rotate integrally with a crankshaft (not shown) which is driven to rotate by the engine 1, and the sensor plate 13 of a disk-shaped configuration has a multitude of projections (not shown) formed on its circumference at intervals of a prescribed crank angle (for instance, 10° CA). Also, untoothed or lost teeth portions are formed on the circumference of the sensor plate 13 at crank angle positions corresponding to a reference position of each cylinder.

A crank angle sensor 14 is arranged in an opposed relation to the sensor plate 13, so that it generates an electrical signal (i.e., pulse of the crank angle signal) to detect the rotational position (crank angle) of the crankshaft when each projection on the sensor plate 13 crosses the crank angle sensor 14.

The engine 1 is provided with valves for controlling communication between the combustion chamber in each cylinder and the intake pipe 4 and the exhaust pipe 10, and the driving or operation timings (opening and closing timings) of each valve (i.e., intake valve and exhaust valve) are determined by camshafts to be described later which are driven to rotate at a speed of ½ of the rotational speed of the crankshaft.

Variable cam phase actuators 15, 16 individually change the intake and exhaust valve opening and closing timings.

Specifically, each of the actuators 15, 16 includes a retard angle hydraulic chamber and an advance angle hydraulic chamber (not shown), which are divided or separated from each other, for relatively changing the rotational position (rotational phase: cam angle) of the corresponding camshaft 15C or 16C with respect to the crankshaft.

Each of the cam angle sensors 17, 18 is arranged in an opposed relation with respect to a corresponding cam angle detection sensor plate (not shown) for generating a pulse signal (cam angle signal) to detect the cam angle of the corresponding camshaft by each projection formed on the circumference of the cam angle detection sensor plate, like the crank angle sensor 14.

Each pulse included in each cam angle signal functions as a cylinder identification signal and it is also used for detecting the cam angle of the corresponding camshaft changed by the corresponding cam angle changing means.

Oil control valves (hereinafter referred to as "OCVs") 19, 20 together with an oil pump (not shown) constitute an oil pressure supply system for switchingly controlling the oil pressure supplied to the respective actuators 15, 16 to control the cam phases of the corresponding camshafts. Note that the oil pump is driven by the crankshaft to supply hydraulic oil to the actuators 15, 16 through the OCVs 19, 20, respectively.

An electronic control unit (hereinafter referred to as an ECU) 21 in the form of a microcomputer constitutes a control means for controlling the engine 1. Specifically, the ECU 21 controls the injector 7, the spark plugs 8 and the cam angle phases of the respective camshafts 15C, 16C in accordance with the engine operating conditions detected by various sensor means 3, 11, 14, 17 and 18.

In addition, though not illustrated herein, a throttle opening sensor is mounted on the throttle valve 5 for detecting the opening degree thereof (throttle opening), and a water temperature sensor is installed on engine 1 for detecting the temperature of engine cooling water. The throttle opening and the temperature of cooling water are input to the ECU 21 as information indicating the operating conditions of the engine 1 in addition to the above-mentioned various sensor information.

As shown in FIG. 8, the engine 1 with a variable valve operating timing (VVT) mechanism is provided with the actuators 15, 16 for changing the relative phase positions of the camshafts 15C, 16C with respect to the crankshaft.

Next, reference will be made to the general engine control operation according to the conventional valve timing control apparatus for an internal combustion engine shown in FIG. 8.

First of all, the airflow sensor 3 measures the amount of intake air sucked into the engine 1 and inputs it to the ECU 21 as detection information indicative of an operating condition of the engine 1.

The ECU 21 calculates the amount of fuel corresponding to the measured amount of intake air, drives the injector 7 to inject the amount of fuel thus calculated into the intake pipe 4, and drives the spark plugs 8 to fire the air fuel mixtures in the corresponding combustion chambers in the cylinders of the engine 1 at appropriate timings by controlling the current supply time durations and the current interruption timings of the ignition coils 9.

Moreover, the throttle valve 5 adjusts the amount of intake air supplied to the engine 1 thereby to control the output torque thereof.

The exhaust gas generated by combustion of the air fuel mixture in each cylinder of the engine 1 is exhausted to the ambient atmosphere through the exhaust pipe 10.

At this time, the catalytic converter 12 arranged on the exhaust pipe 10 purifies hydrocarbons (HC) (unburnt gas components), carbon monoxide (CO) and nitrogen oxides (NOx), all of which are harmful substances contained in the exhaust gas, into harmless substances such as $CO_2$, $H_2O$ and the like, which are then exhausted to the ambient atmosphere.

Here, in order to draw out the maximum purification efficiency of the catalytic converter 12, the oxygen sensor 11 is installed on the exhaust pipe 10 to detect the amount of residual oxygen in the exhaust gas, which is input to the ECU 21.

As a result, the ECU 21 controls the amount of fuel injected from the injector 7 in a feedback manner so as to make the air fuel mixture before combustion to be at the stoichiometric air fuel ratio.

Further, the ECU 21 controls the actuators 15, 16 (VVT mechanisms) according to the operating conditions of the engine 1 so that the valve opening and closing timings for the intake and exhaust valves are properly changed.

FIG. 9 is a timing chart that shows the respective pulse waveforms of the crank angle signal and the cam angle signal.

In FIG. 9, crank angle positions are represented by angles before the respective compression top dead centers of cylinders #1–#4.

That is, B05 (BTDC 5°) indicates 5° before top dead center (TDC), and B75 indicates 75° before top dead center. Symbols #1–#4 represent cylinders that come to their compression top dead centers, respectively.

The crank angle sensor 14 generates, as a crank angle signal, a train of pulses at crank angles of a prescribed interval (10° CA).

Furthermore, the crank angle signal includes no-pulse generation portions (corresponding to the untoothed portions) in which no pulse is generated at prescribed crank angle positions (e.g., B95 or B95 and B105) as shown in broken line pulse positions in FIG. 9.

On the other hand, each of the cam angle sensors 17, 18 generates, as the cam angle signal, pulses at prescribed crank angle positions (e.g., B135 or B135 and B100).

Here note that the output positions (crank angle positions) of the crank angle signal and the cam angle signals in FIG. 9 are shown as ideal designed values including no manufacturing error or the like.

The ECU 21 calculates a reference crank angle position (B75) based on an untoothed or lost teeth portion of the crank angle signal, and identifies the cylinders of the engine 1 based on the number of lost teeth (i.e., a loss of one tooth: one lost tooth only at B95, or a loss of two teeth: lost teeth at B95 and B105, respectively) between the successive reference positions of the crank angle signal and the number of pulses of the cam angle signal therebetween.

When the cam angles are shifted to an advance angle side under the action of the actuators 15, 16 that constitute the cam angle changing means, the output signals of the cam angle sensors 17, 18 are also shifted to an advance angle side.

If the operating range of each of the actuators 15, 16 is an angular interval of 50° CA, a pulse of the cam angle signal at the most advanced angle (see a lower row in FIG. 9) is generated at a crank angle position advanced by an angle of 50° CA from the most retarded angle position (see a middle row in FIG. 9).

Now, reference will be made to the cam angle detection operation of the conventional valve timing control apparatus for an internal combustion engine while referring to FIG. 9.

Using a crank angle position (B75) of the crank angle signal which becomes a reference for the calculation of the cam angle, the ECU 21 in FIG. 8 calculates an angle θc from a cam angle signal position (B135) to the crank angle position (B75), based on which cam angles corresponding to valve operating (opening and closing) timings are calculated.

At this time, in order to calculate the angle θc from the reference position (B75) of the crank angle signal to the pulse detection position (B135) of the cam angle signal, there is used the relation between a time interval between successive reference positions (B75) of the crank angle signal and a time duration Tc from each reference position (B75) of the crank angle signal to the pulse detection position (B135) of the cam angle signal.

FIG. 10 is an explanatory view indicating the time required for the crankshaft to rotate each constant crank angle of (10° CA) when the engine 1 is in the steady-state operation (e.g., running at a rotational speed of 1667 r/m). In FIG. 10, the axis of abscissa represents crank angle [deg CA] and the axis of ordinate represents time [ms].

In FIG. 10, for instance, 55 [deg CA] indicates the time required for rotation from B65 to B55 (an angle of 10° CA).

Moreover, the time required for the crankshaft to rotate by an angle of 10° CA becomes longer in the vicinity of 0 [deg CA] that is compression top dead center, owing to the compressive resistance of the intake air.

On the contrary, after compression top dead center, the time required for the crankshaft to rotate by 10° CA becomes shorter due to the torque generated by combustion of the air fuel mixture.

Even if the engine 1 is in the steady-state operation, there takes place a variation in the required time resembling a sine wave cycle in which a maximum value is reached in the vicinity of compression top dead center at angular intervals of 180 [deg CA], as shown in FIG. 10.

FIG. 11 is an explanatory view showing the time variation of FIG. 10 as a table.

As shown in FIG. 11, when the rotational speed of the engine 1 is 1667 [r/m], it takes a time of 18 [ms] for the engine 1 or the crankshaft to rotate by 180 [deg CA], and at this time the average time for the crankshaft rotation of 10 [deg CA] is 1 [ms].

In addition, the time required for the crankshaft to rotate by 60 [deg CA] from a pulse signal position (B135) of the cam angle signal to a reference position (B75) of the crank angle signal becomes 5.568 [ms] because of the periodic or cyclic change of the rotational speed of the engine 1 due to its compression and combustion.

Accordingly, in cases where the cam angle is calculated by using the cycle time as in the above-mentioned conventional apparatus, an angle θc' from the crank angle position (B135) of the cam angle signal to the reference position (B75) of the crank angle signal is represented by the following expression (1).

$$\theta c' = 5.568\,[\mathrm{ms}]/18\,[\mathrm{ms}] \times 180\,[\mathrm{deg}\,CA] = 55.68\,[\mathrm{deg}\,CA] \quad (1)$$

Therefore, a measurement error Δθ between the calculated angle θc' and the actual angle θc is represented by the following expression (2).

$$\Delta\theta = \theta c - \theta c' = 60\ [\mathrm{deg}\ CA] - 55.68\ [\mathrm{deg}\ CA] = 4.32\ [\mathrm{deg}\ CA] \quad (2)$$

With the conventional valve timing control apparatus for an internal combustion engine as described above, even when the internal combustion engine is in the steady-state operation, the angular speed of the engine varies depending on its respective strokes such as compression stroke, combustion stroke, etc., thus giving rise to the following problem. That is, the cam angle is calculated based on the time between successive reference signals of the crank angle sensor and the time between the crank angle signal and the cam angle signal, and hence the cam angle thus calculated involves an error that is caused by the influence of variations in the angular speed of the engine.

In addition, there arises another problem in that since the relation between the time interval of successive reference positions (B75) and the time Tc from each reference position (B75) of the crank angle signal to a position (B135) of the cam angle signal is used, there takes place a measurement error Δθ between the calculated angle θc' and the actual angles θc, and a calculation error of the cam angle becomes greater particularly during acceleration or deceleration of the engine than during the steady-state operation thereof.

SUMMARY OF THE INVENTION

The present invention is intended to solve the problems as referred to above, and has for its object to provide a valve timing control apparatus for an internal combustion engine which is capable of calculating and controlling a cam angle with high accuracy by reducing a calculation error of the cam angle, thereby preventing deteriorations in driveability, fuel consumption and exhaust emissions.

Bearing the above object in mind, the present invention resides in a valve timing control apparatus for an internal combustion engine which includes: sensors for detecting operating conditions of the internal combustion engine; a crank angle sensor for generating a crank angle signal including a train of pulses which correspond respectively to rotational angles of a crankshaft of the internal combustion engine; and an intake camshaft and an exhaust camshaft for driving intake and exhaust valves, respectively, of the internal combustion engine in synchronization with the rotation of the crankshaft. The apparatus further includes; a cam angle changing part mounted on at least one of the intake and exhaust camshafts for changing the phase of the at least one of the camshafts relative to the crankshaft; a cam angle sensor mounted on the at least one camshaft whose phase relative to the crankshaft is changed by the cam angle changing part, for generating a cam angle signal for identifying respective cylinders of the internal combustion engine and for detecting a cam angle of the at least one camshaft whose relative phase to the crankshaft is changed by the cam angle changing part; a reference crank angle position calculation part for calculating reference crank angle positions based on the crank angle position signal; a cam angle calculation part for calculating the cam angle based on the crank angle signal and the cam angle signal; and a cam angle control part for controlling the cam angle changing part based on the operating conditions of the internal combustion engine and the cam angle calculated by the cam angle calculation part in such a manner that the phase of the camshaft relative to the crankshaft is controlled so as to coincide with a target cam angle which corresponds to the operating conditions of the internal combustion engine. The cam angle calculation part calculates the cam angle by counting the number of pulses of the crank angle signal. According to this arrangement, it is possible to control the valve timing control apparatus for an internal combustion engine in an accurate manner by calculating the cam angle with high accuracy. As a result, it is possible to prevent deteriorations in driveability, fuel consumption and exhaust emissions.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Embodiment 1

Hereinafter, preferred embodiments of the present invention will be described in detail while referring to the accompanying drawings.

Figure 1:
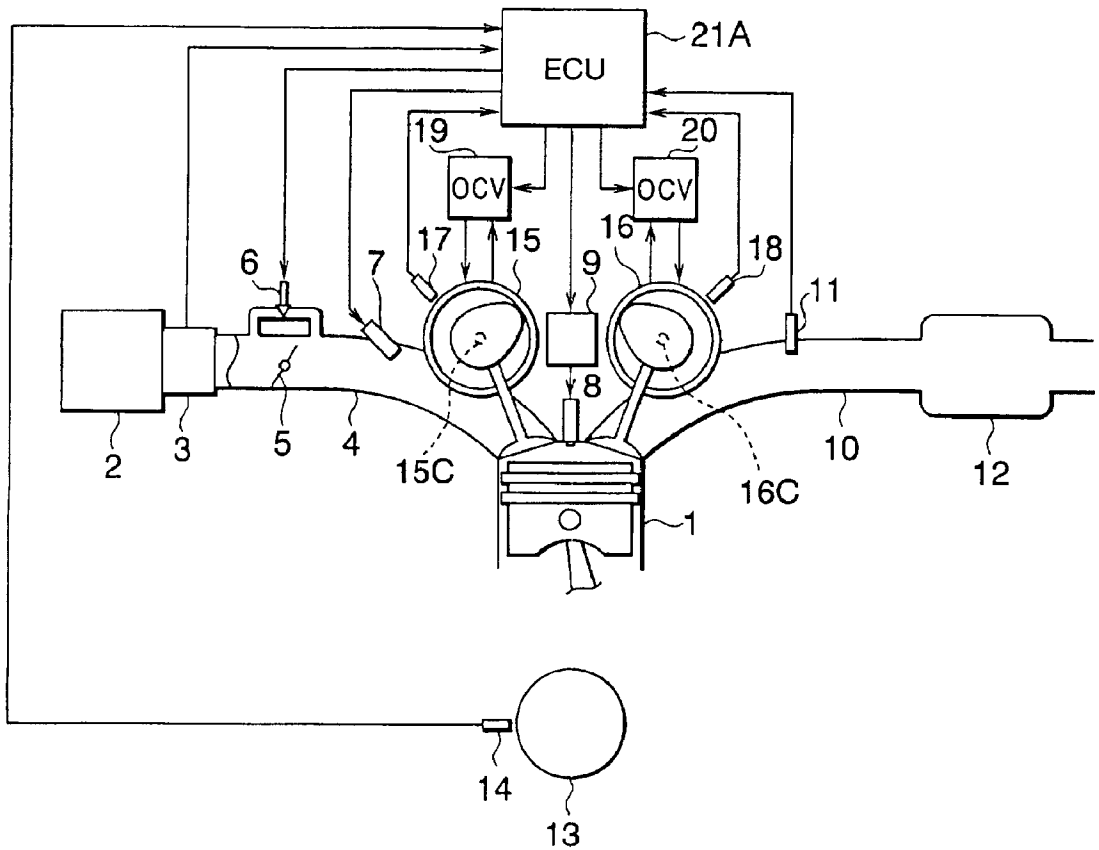
FIG. 1 is a block diagram showing the construction of a valve timing control apparatus for an internal combustion engine according to a first embodiment of the present invention.
Figure 8:
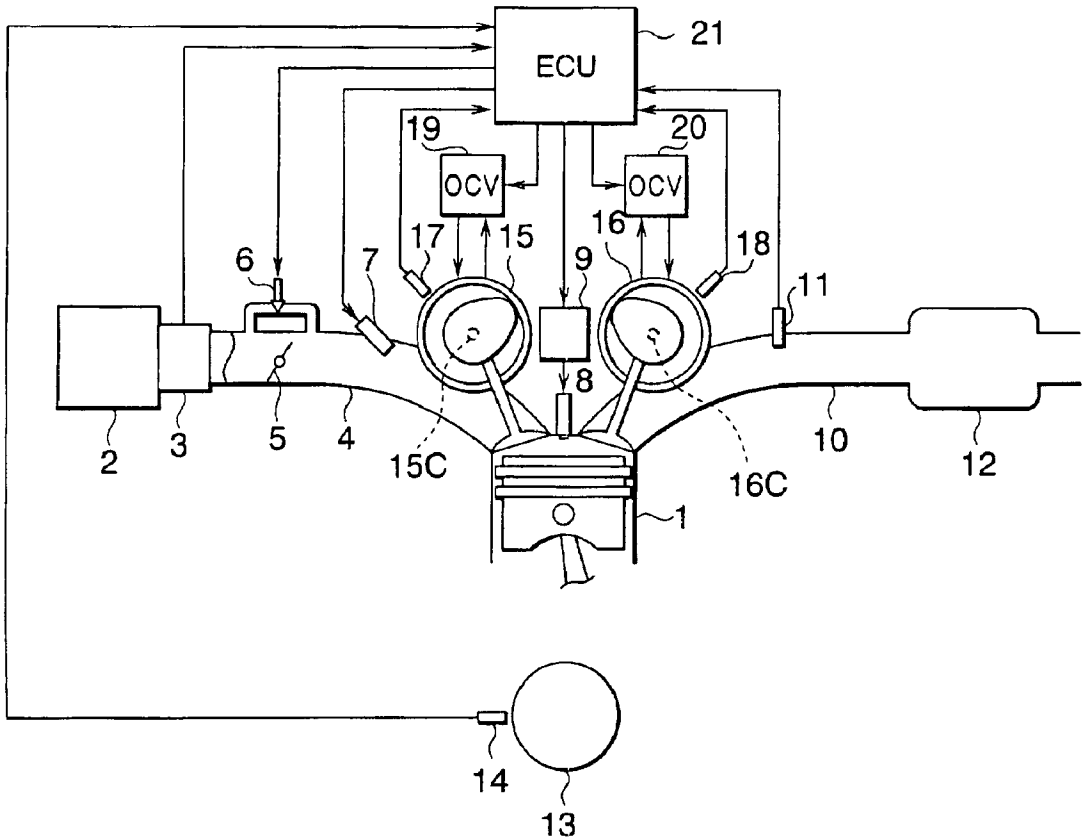
FIG. 8 is a block diagram illustrating the construction of a conventional valve timing control apparatus for an internal combustion engine.

FIG. 1 is a block diagram showing a valve timing control apparatus for an internal combustion engine in accordance with a first embodiment of the present invention. In FIG. 1, the same or corresponding parts or elements as those in the above-mentioned conventional apparatus (see FIG. 8) are identified by the same symbols.

In addition, an ECU 21A in FIG. 1 controls cam angles (the relative rotational phases of intake and exhaust camshafts 15C, 16C with respect to an unillustrated crankshaft) and an engine 1 by controlling intake and exhaust actuators 15, 16 as in the case of the above-mentioned conventional apparatus.

That is, though not illustrated, the ECU 21A includes a reference crank angle calculation means for calculating a reference crank angle based on a crank angle signal generated by a crank angle sensor 14, a cam angle calculation means for calculating cam angles (i.e., angular or rotational positions of the camshafts 15C, 16C) based on the crank angle signal and cam angle signals which are generated by intake and exhaust cam angle sensors 17, 18, respectively, and a cam angle control means for controlling the relative phases of the camshafts 15C, 16C with respect to the crankshaft.

The cam angle control means in the ECU 21A controls the actuators 15, 16 (cam angle changing means) based on the operating conditions of the engine 1 and the cam angles calculated by the cam angle calculation means, so that the relative phases of the camshafts 15C, 16C are controlled to coincide with target cam angles corresponding to the engine operating conditions.

In this case, it is to be noted that only part of the function of the cam angle control means in the ECU 21A is different from that in the ECU 21 (see FIG. 8) of the above-mentioned conventional apparatus.

Figure 9:
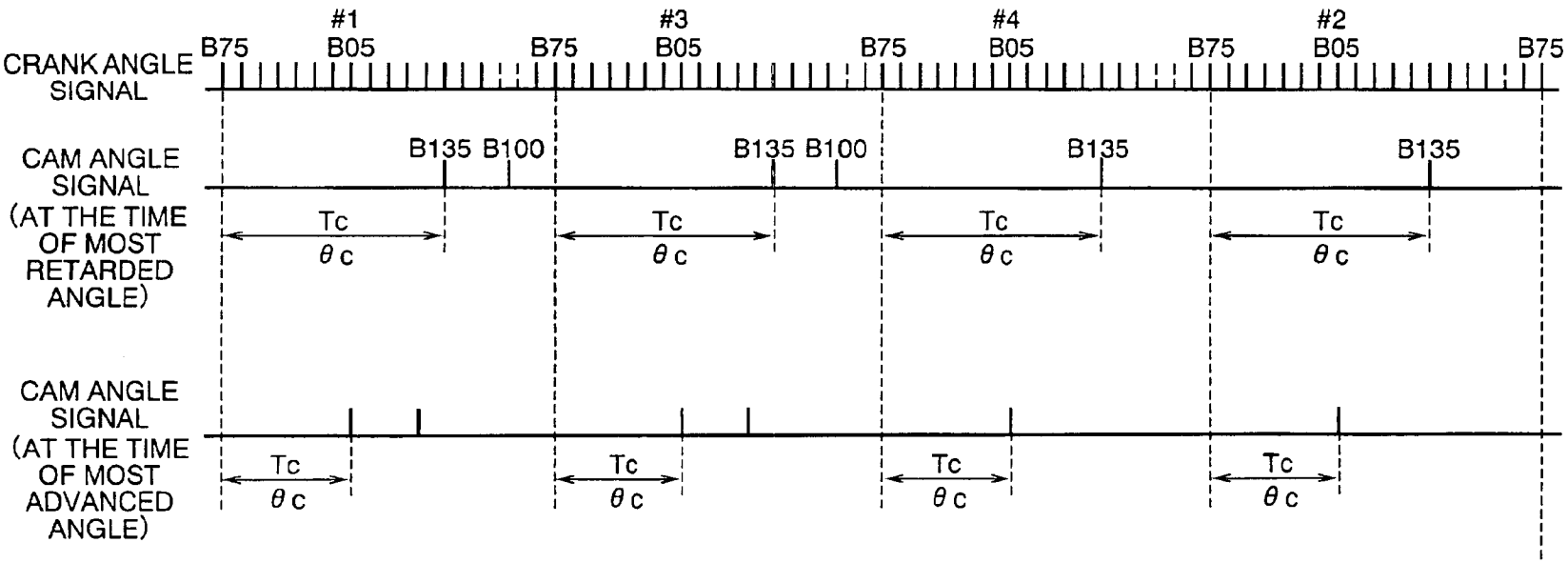
FIG. 9 is a timing chart illustrating a generation pattern of a crank angle signal consisting of a lot of pulses together with cam angle signals.
Figure 10:
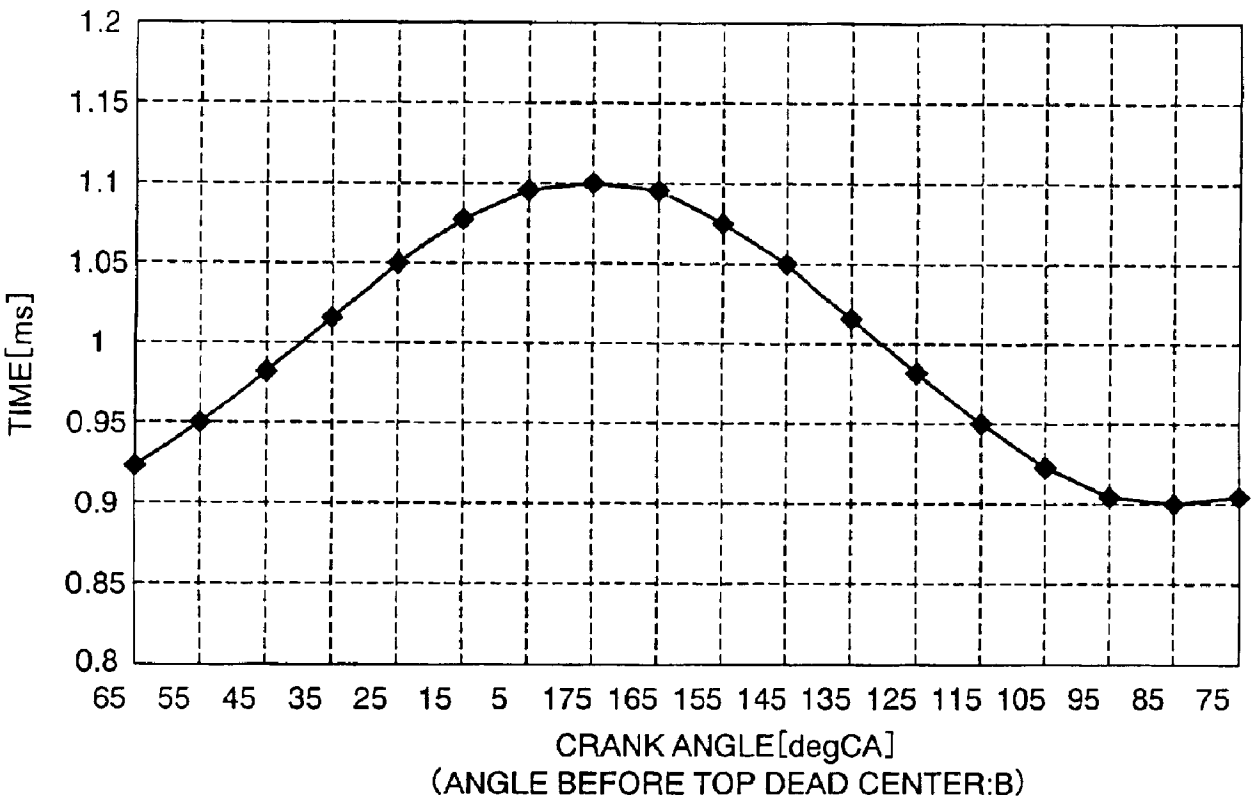
FIG. 10 is an explanatory view illustrating a cam angle calculation processing operation in a waveform according to the conventional valve timing control apparatus for an internal combustion engine.

That is, by using the crank angle signal consisting of a train of pulses as shown in FIG. 9, the cam angle calculation means in the ECU 21A counts the number of pulses of the crank angle signal (the number of interrupts generated according to the crank angle signal) detected from a detection position (B135) of each cam angle signal to a reference position (B75) of the crank angle signal thereby to calculate the respective cam angles.

In this case, if the cam angle signals from the cam angle sensors 17, 18 and the crank angle signal from the crank angle sensor 14 are generated as expected in a designed manner, there will be coincidence between the crank angle position (B135) of the crank angle signal and the pulse position (B135) of the cam angle signals, and hence there takes place no time difference.

In FIG. 9, when the number of pulses of the crank angle signal is counted from the detection position (B135) of each cam angle signal to the reference position (B75) of the crank angle signal, the counted number of pulses of the crank angle signal becomes "4" at the time point of detection of the reference position (B75) before a crank angle position (B05) of cylinder #3.

Since the number of lost teeth before the reference position (B75) at this time is two (or a "two teeth loss"), the crank angle interval of this untoothed portion becomes 30 deg CA.

Therefore, an angle θc from the position (B135) of each cam angle signal to the reference position (B75) of the crank angle signal is represented by the following expression (3).

$$\theta c = 10\ [\text{deg } CA] \times 3 + 30\ [\text{deg } CA] \times 1 = 60\ [\text{deg } CA] \quad (3)$$

The angle θc calculated from expression (3) above does not include any measurement error with respect to the actual angle θc.

In expression (3) above, an angular difference of each cam angle from the reference position (B75) of the crank angle signal is calculated as a cam angle, but in case of pulse signals as shown in FIG. 9 in which the absolute value of the crank angle position of each pulse of the crank angle signal is known, the angle of a pulse generated at the detection position of the cam angle signal may instead be calculated as an angular difference thereof from the absolute value (or designed value) of the corresponding crank angle position (B135) of the crank angle signal.

Figure 2:
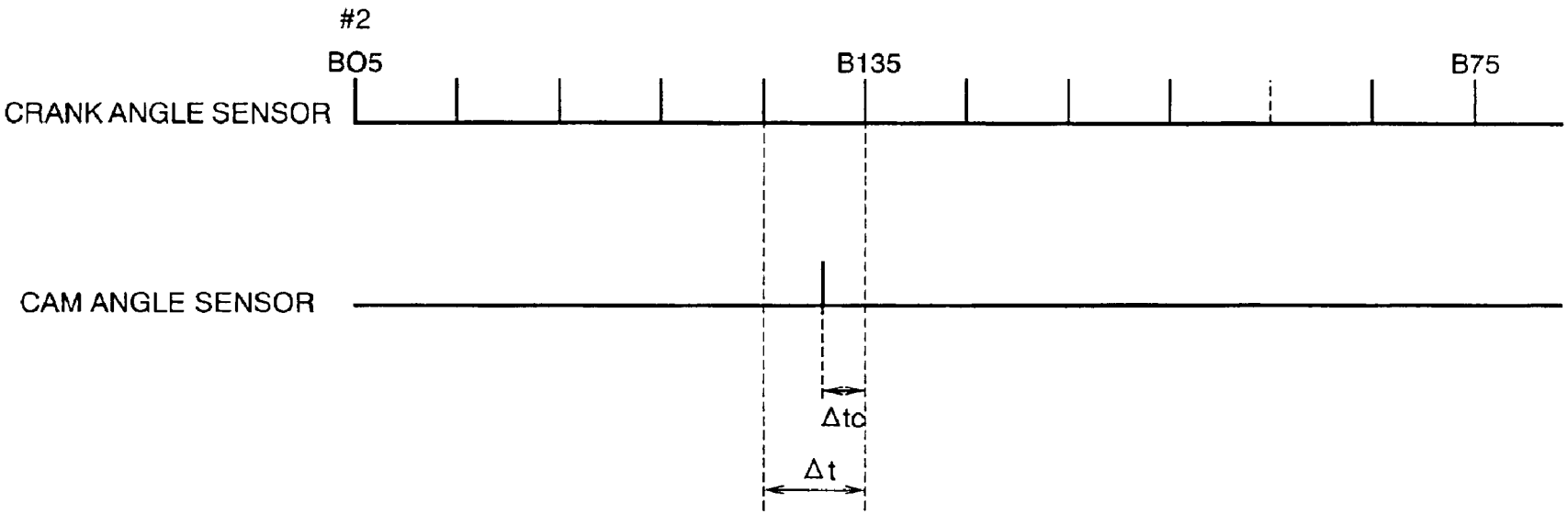
FIG. 2 is a timing chart illustrating a cam angle calculation operation according to the first embodiment of the present invention.

FIG. 2 is an explanatory view illustrating the crank angle signal and a cam angle signal when the position of a pulse of the cam angle signal is different from its designed pulse position.

For instance, when the detection position of a cam angle signal shifts from its designed value (B135) due to a mounting error of a corresponding cam angle sensor, etc., a pulse of the cam angle signal comes to be generated between successive pulses of the crank angle signal, as shown in FIG. 2.

Moreover, when the valve timing is controlled to an advance angle side, there is frequently generated a pulse pattern as shown in FIG. 2.

In this case, an angle corresponding to a time difference Δtc between a detection position of the cam angle signal and the position (B135) of a corresponding pulse of the crank angle signal is detected by using the time difference Δtc and a time Δt between the successive pulses of the crank angle signal between which there exits the detection position of the cam angle signal. Note that a concrete calculation method therefor will be described later.

FIG. 3 through FIG. 6 are flow charts illustrating the processing operation of the apparatus from the valve timing calculation processing to the valve timing control processing according to the first embodiment of the present invention.

Figure 3:
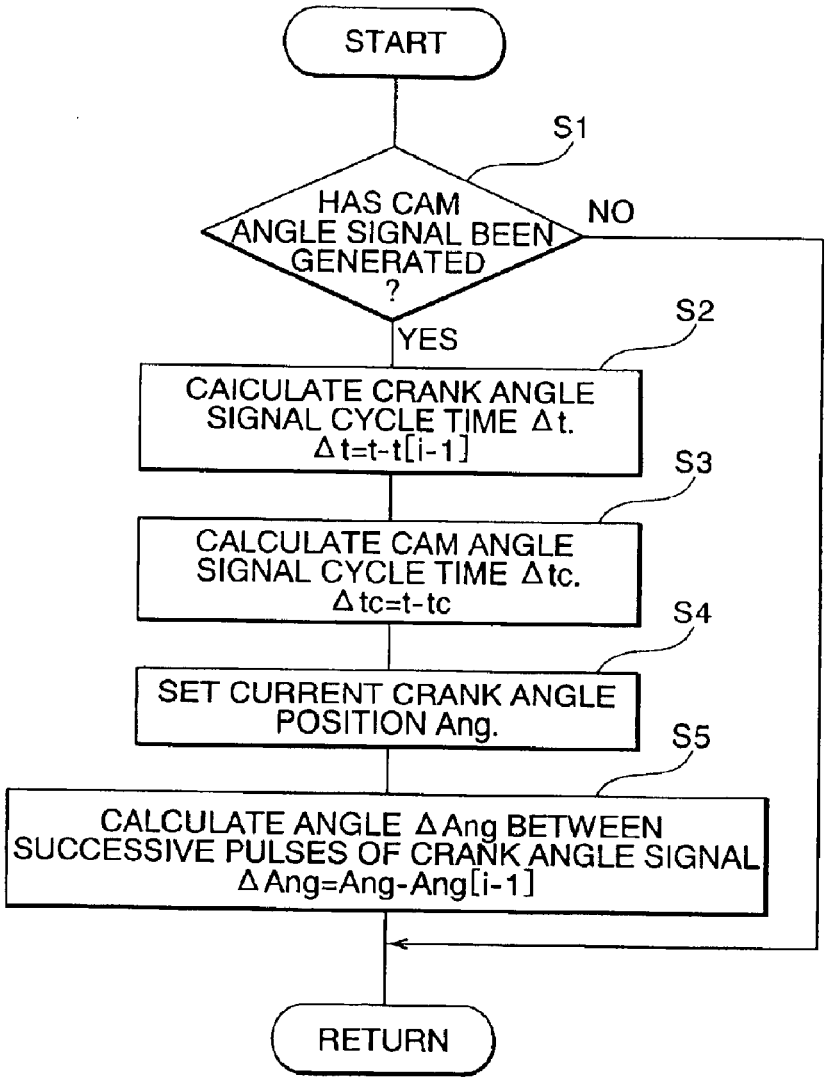
FIG. 3 is a flow chart illustrating the processing operation of calculating an angle between successive pulses of a crank angle signal according to the first embodiment of the present invention.

FIG. 3 shows the time calculation processing and the angle calculation processing of calculating the time and angle, respectively, between pulses upon detection of a pulse of the cam angle signal.

Figure 4:
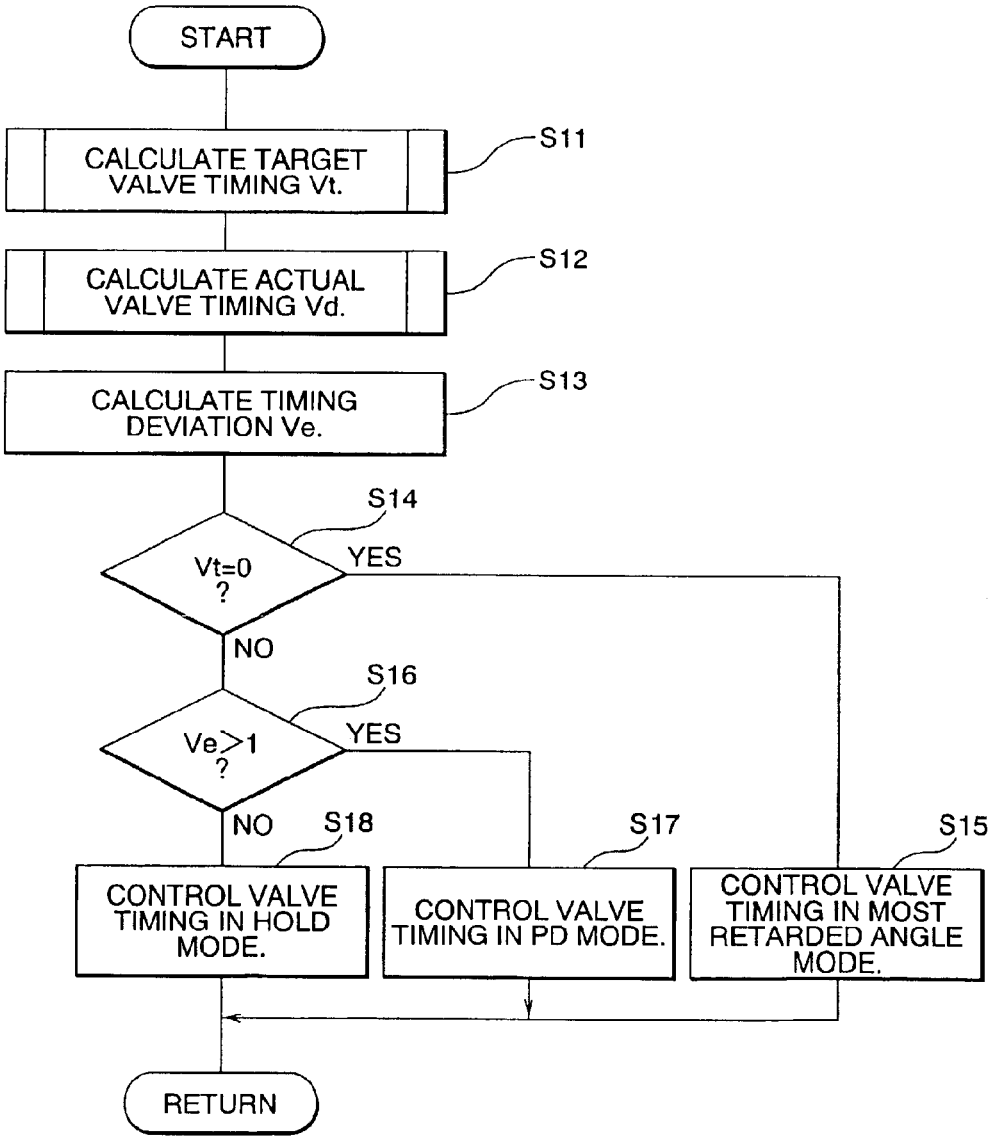
FIG. 4 is a flow chart illustrating the calculation processing in a valve timing control mode according to the first embodiment of the present invention.
Figure 5:
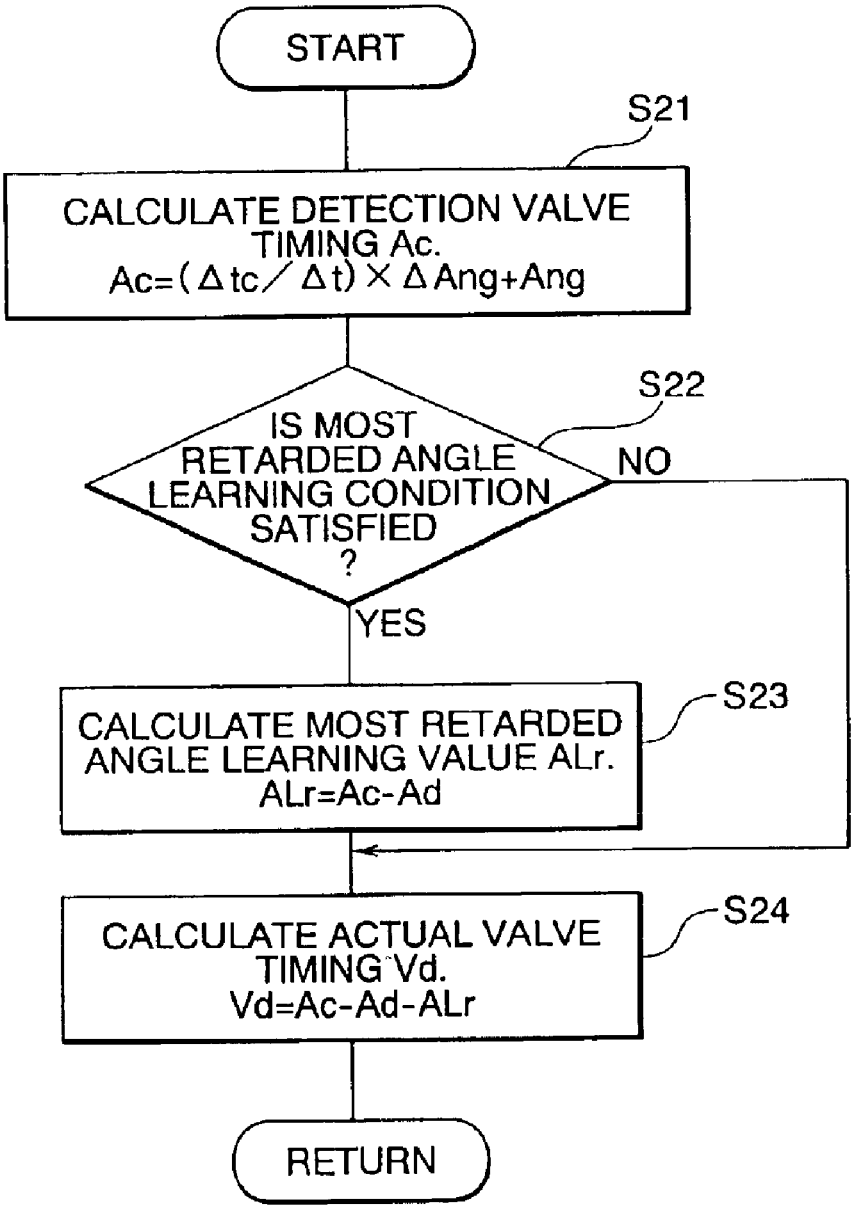
FIG. 5 is a flow chart concretely showing the calculation processing of the actual valve timing in FIG. 4.
Figure 6:
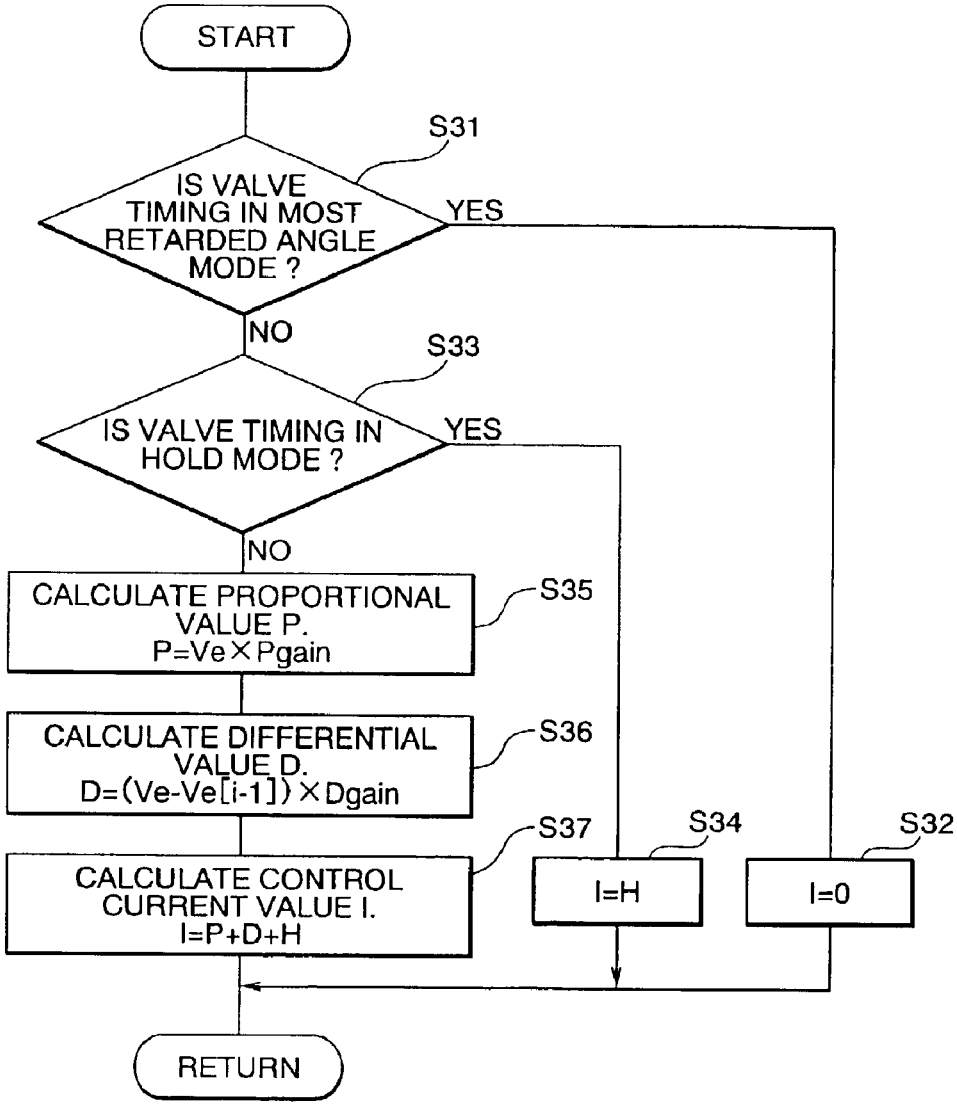
FIG. 6 is a flow chart illustrating the processing of calculating a control amount for valve timing control according to the first embodiment of the present invention.

FIG. 4 shows the calculation processing in a valve timing control mode; FIG. 5 shows the calculation processing of actual valve timing in FIG. 4; and FIG. 6 shows the control amount calculation processing for valve timing control.

The interrupt processing of FIG. 3 is performed each time a pulse of the crank angle signal from the crank angle sensor 14 is generated at a constant crank angle interval (10° CA). In addition, each time a reference position (B75) of the crank angle signal is detected, the interrupt processing of FIG. 4 through FIG. 6 is performed.

Hereinafter, reference will be made to the processing operation of calculating an angle (ΔAng) between successive pulses of the crank angle signal while referring to FIG. 3.

In FIG. 3, first of all, it is determined whether there has been generated a cam angle signal within an interval from the last pulse to the current pulse of the crank angle signal (step S1).

Here, note that another interrupt processing (not shown) is performed for each cam angle signal, and the generation of a pulse of each cam angle signal is stored in the memory as a flag.

If it is determined in step S1 that there has been generated no cam angle signal (that is, NO), the routine of FIG. 3 is exited without performing other processing, whereas if it is determined that there has been generated a pulse of the cam angle signal (that is, YES), a difference between the current crank angle signal generation time t and the last crank angle signal generation time t[i−1], that is, the time between the generation of the current pulse and that of the last pulse of the crank angle signal, is stored as a crank signal cycle time Δt (=t−t[i−1]) (step S2).

Subsequently, a difference between the current crank angle signal generation time t and the current cam angle signal generation time tc is stored as a cam signal cycle time Δtc (=t−tc) (step S3), and a crank angle position Ang at the time when this processing is performed is also stored (step S4).

At this time, since the lost teeth exist at the prescribed crank angle positions as previously stated, the current crank angle position Ang can be grasped or specified.

Thereafter, the last crank angle position Ang[i−1] is subtracted from the current crank angle position Ang to provide an angle ΔAng (=Ang−Ang[i−1]) between successive pulses of the crank angle signal (step S5), and the processing routine of FIG. 3 is then exited.

Figure 11:
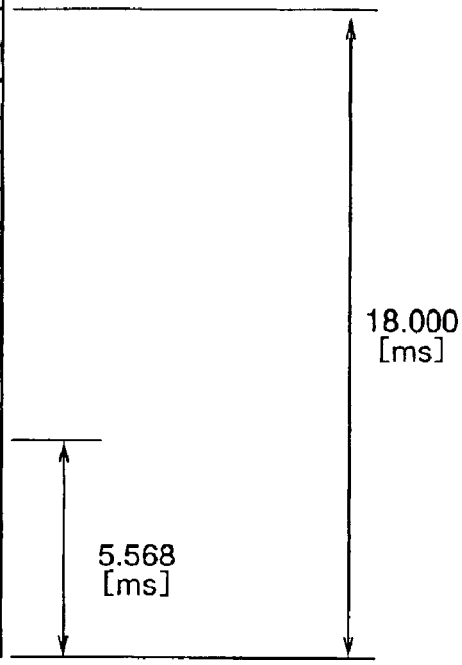
FIG. 11 is an explanatory view illustrating the cam angle calculation processing operation in a table form according to the conventional valve timing control apparatus for an internal combustion engine.

The angle ΔAng between successive pulses of the crank angle signal is usually 10 [deg CA], but it becomes either 20 [deg CA] or 30 [deg CA] at the untoothed or lost teeth portions, as shown in FIG. 11.

Next, reference will be made to the calculation processing for determining the valve timing control mode while referring to FIG. 4.

In FIG. 4, first of all, a target valve timing Vt is calculated from the engine operating conditions (step S11).

At this time, the target valve timing Vt is set in the memory in the ECU 21A as a two-dimensional map that can be referred to by the rotational speed and the load (charging efficiency) of the engine 1 for instance. Accordingly, the target valve timing Vt can be obtained by referring to the two-dimensional map according to the rotational speed and charging efficiency of the engine 1 at the time of the calculation processing in step S11.

Then, an actual valve timing Vd is calculated by using the calculation processing of FIG. 5 (to be described later) (step S12), and the actual valve timing Vd thus calculated is subtracted from the target valve timing Vt to provide an amount of timing deviation Ve (step S13).

Subsequently, it is determined whether the target valve timing Vt is zero (step S14), and if determined as Vt=0 (that is, YES), the valve operating timing is controlled in a most retarded angle mode (step S15) and then the processing routine of FIG. 4 is exited.

On the other hand, if in step S14 it is determined as Vt≠0 (that is, NO), a determination is then made as to whether the amount of timing deviation Ve is greater than 1 [deg CA] (step S16).

In step S16, if determined as Ve>1 [deg CA] (that is, YES), the valve operating timing is controlled in a PD mode for feedback control (step S17) and the processing routine of FIG. 4 is then exited, whereas if determined as Ve≦1 [deg CA] (that is, NO), the valve operating timing is controlled in a hold mode (step S18) and the processing routine of FIG. 4 is then exited.

Next, reference will be made concretely to the step S12 (actual valve timing calculation processing operation) in FIG. 4 while referring to FIG. 5.

In FIG. 5, first of all, the cam signal cycle time Δtc divided by the crank angle cycle time Δt is multiplied by the interpulse angle ΔAng between successive pulses of the crank angle signal and then added by the current crank angle position Ang to provide a detection valve timing Ac according to the following expression (4) (step S21).

$$Ac=(\Delta tc/\Delta t)\times\Delta Ang+Ang \quad (4)$$

Then, it is determined whether a most retarded angle learning condition is satisfied (step S22). For example, the most retarded angle learning condition is satisfied when a predetermined time (e.g., 1 [sec]) has elapsed after the valve operating timing has come to be controlled in the most retarded angle mode (step S15 in FIG. 4).

In step S22, if it is determined that the most retarded angle learning condition is satisfied (that is, YES), a valve timing designed value Ad is subtracted from the detection valve timing Ac to provide a most retarded angle learning value ALr(=Ac−Ad) (step S23).

Thus, a timing deviation between the detection valve timing Ac and the valve timing designed value Ad is learned as the most retarded angle learning value ALr.

On the other hand, if it is determined in step S22 that the most retarded angle learning condition is not satisfied (that is, NO), the processing in step S23 is not performed.

The most retarded angle learning value ALr is stored in the RAM in the ECU 21A which is backed up by an on-board battery mounted on a vehicle, so that it is kept stored after an ignition switch of the vehicle is turned off (i.e., after stoppage of the engine 1).

Finally, the valve timing designed value Ad and the most retarded angle learning value ALr are subtracted from the detection valve timing Ac to provide an actual valve timing Vd (step S24), and the processing routine of FIG. 5 is then exited.

Next, reference will be made to the processing of calculating a control amount which is used for making the actual valve timing Vd follow the target valve timing Vt, while referring to FIG. 6.

In FIG. 6, first of all, it is determined whether the valve operating timing is controlled in the most retarded angle mode (step S31), and if determined that the valve operating timing is in the most retarded angle mode (that is, YES), a control current value I is set to 0 [mA] (step S32), and the processing routine of FIG. 6 is then exited.

On the other hand, if it is determined in step S31 that the valve operating timing is not in the most retarded angle mode (that is, NO), a determination is then made as to whether the valve operating timing is in a hold mode (step S33).

In step S32, if it is determined that the valve operating timing is in a hold mode (that is, YES), a hold current learning value H is set to the control current value I (step S34), and the processing routine of FIG. 6 is then exited. Here, note that the hold current learning value H is a value which is obtained by learning the control current value in a state where the actual valve timing Vd substantially follows the target valve timing Vt (e.g., valve timing deviation amount Ve≦1 [deg CA]).

On the other hand, in step S33, if it is determined that the valve operating timing is not in a hold mode (that is, NO), it is assumed that the valve operating timing is in a PD mode, and the current amount of deviation Ve is multiplied by a proportional gain Pgain to provide a proportion value P (step S35).

Subsequently, the current amount of deviation Ve subtracted by the last amount of deviation Ve[i−1] is multiplied by a differential gain Dgain to provide a differential value D (step S36).

In addition, the proportion value P, the differential value D and the hold current learning value H are added to one another to provide the control current value I (step S37), and the processing routine of FIG. 6 is then exited.

Thus, after the control current value I has been calculated, the amounts of oil from the OCVs to the actuators 15, 16 (see FIG. 1) are adjusted by controlling the duty value of each OCV in a feedback manner so as to make the current value detected from each OCV drive circuit coincide with the control current value I. As a result, the actual valve timing Vd is controlled to coincide with the target valve timing Vt.

Thus, it is possible to calculate the detection valve timing Ac by using the crank angle signal consisting of a train of pulses, based on the crank angle position at the time of detection of the crank angle signal immediately after the detection of the cam angle signal, the time between successive pulses of the crank angle signal, and the time measured between the cam angle signal and the crank angle signal.

Therefore, detection errors of the detection valve timing Ac at the time of a periodic or cyclic change, a transient operation or the like can be eliminated, thereby making it possible to accurately control the valve timing (cam angle).

Moreover, since calculation errors of the cam angle can be suppressed, the cam angle can be calculated and hence controlled with high accuracy, so that the operation performance of the engine 1 can be improved, thus making it possible to enhance the quality or performance of exhaust emissions, fuel consumption and driveability.

Embodiment 2

Although in the above-mentioned first embodiment, the valve timing designed value Ad is subtracted from the detection valve timing Ac to provide the most retarded angle learning value ALr and the actual valve timing Vd in steps S23, S24, the most retarded angle learning value ALr and the actual valve timing Vd can be calculated without the subtraction of the valve timing designed value Ad.

Figure 7:
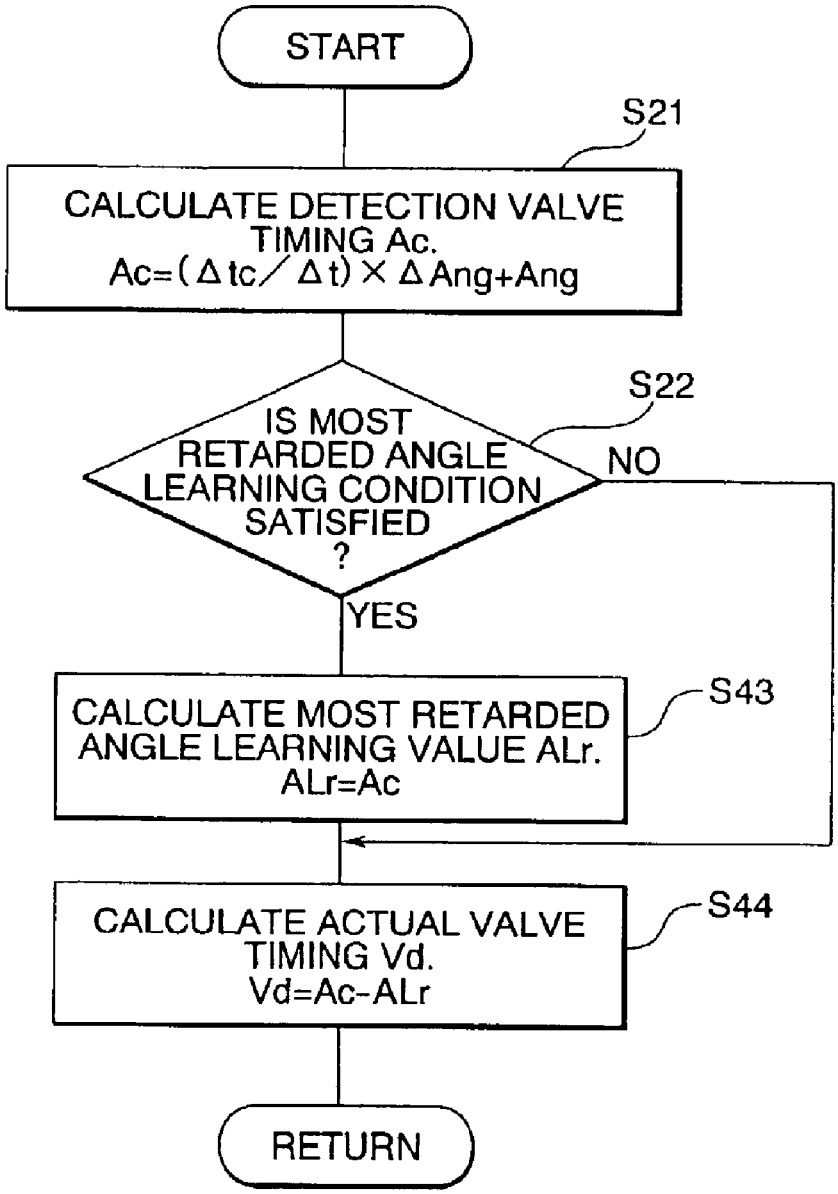
FIG. 7 is a flow chart illustrating the processing of calculating actual valve timing according to a second embodiment of the present invention.

FIG. 7 is a flow chart illustrating a calculation processing operation for the most retarded angle ALr and the actual valve timing Vd according to a second embodiment of the present invention.

In FIG. 7, steps S21 and S22 are processes similar to those as referred to above (see FIG. 5), and hence a detailed explanation thereof is omitted here.

In FIG. 7, the detection valve timing Ac is first calculated (step S21), and it is then determined whether the most retarded angle learning condition is satisfied (step S22). If determined that the most retarded angle learning condition is satisfied (that is, YES), the detection valve timing Ac thus calculated is made the most retarded angle learning value ALr as it is (step S43).

Further, the value obtained by subtracting the most retarded angle learning value ALr from the detection valve timing Ac is calculated as the actual valve timing Vd (step S44), and the processing routine of FIG. 7 is then exited.

In this manner, the detection valve timing Ac is learned as the most retarded angle learning value ALr as it is, and a deviation between the detection valve timing Ac and the most retarded angle learning value ALr is calculated as the actual valve timing Vd.

As a result, even if control for making the actual valve timing Vd follow the target valve timing Vt is carried out, there will be achieved substantially similar advantageous effects as in the above-mentioned first embodiment.

That is, detection errors of the cam angle can be suppressed, whereby the quality or performance of exhaust emissions, fuel consumption and driveability can be improved.

Although in the above-mentioned first and second embodiments, provision is made for the cam angle changing means (actuators 15, 16 and OCVs 19, 20) in relation to both of the intake and exhaust valves, such a cam angle changing means may be provided in relation to only either one of the intake and exhaust valves.

As described in the foregoing, the present invention provides the following excellent advantages.

According to the present invention, there is provided a valve timing control apparatus for an internal combustion engine comprising: sensor means for detecting operating conditions of the internal combustion engine; a crank angle sensor for generating a crank angle signal including a train of pulses which correspond respectively to rotational angles of a crankshaft of the internal combustion engine; and an intake camshaft and an exhaust camshaft for driving intake and exhaust valves, respectively, of the internal combustion engine in synchronization with the rotation of the crankshaft. The apparatus further comprises; cam angle changing means mounted on at least one of the intake and exhaust camshafts for changing the phase of the at least one of the camshafts relative to the crankshaft; a cam angle sensor mounted on the at least one camshaft whose phase relative to the crankshaft is changed by the cam angle changing means, for generating a cam angle signal for identifying respective cylinders of the internal combustion engine and for detecting a cam angle of the at least one camshaft whose relative phase to the crankshaft is changed by the cam angle changing means; reference crank angle position calculation means for calculating reference crank angle positions based on the crank angle position signal; cam angle calculation means for calculating the cam angle based on the crank angle signal and the cam angle signal; and cam angle control means for controlling the cam angle changing means based on the operating conditions of the internal combustion engine and the cam angle calculated by the cam angle calculation means in such a manner that the phase of the camshaft relative to the crankshaft is controlled so as to coincide with a target cam angle which corresponds to the operating conditions of the internal combustion engine. The cam angle calculation means calculates the cam angle by counting the number of pulses of the crank angle signal. With the above arrangement, the valve timing control apparatus for an internal combustion engine can be precisely controlled by calculating the cam angle with high accuracy. As a result, it is possible to prevent deteriorations in driveability, fuel consumption and exhaust emissions.

Preferably, the cam angle calculation means comprises storage means for storing crank angle positions of the crankshaft, and wherein when the cam angle signal has been detected within a duration from detection timing of the last pulse of the crank angle signal to detection timing of the current pulse thereof, a crank angle position at the detection timing of the current pulse is stored in the storage means so that the cam angle is calculated by using the crank angle position thus stored.

Preferably, when the cam angle signal is detected between successive pulses of the crank angle signal, the cam angle calculation means calculates the cam angle by using a time measured between the successive pulses and a time measured between the cam angle signal and the crank angle signal.

Preferably, the cam angle control means comprises cam angle learning means for learning reference positions of the cam angle, wherein when the cam angle changing means is out of operation, the cam angle learning means learns an angular deviation between the cam angle calculated by the cam angle calculation means and a designed value of the crank angle position.

Preferably, the cam angle control means comprises cam angle learning means for learning reference positions of the cam angle, and when the cam angle changing means is out of operation, the cam angle learning means learns a crank angle position corresponding to the cam angle calculated by the cam angle calculation means.

Preferably, the cam angle control means controls the cam angle changing means by using the reference positions learned by the cam angle learning means.

While the invention has been described in terms of preferred embodiments, those skilled in the art will recognize that the invention can be practiced with modifications within the spirit and scope of the appended claims.

What is claimed is:

1. A valve timing control apparatus for an internal combustion engine comprising:

sensor means for detecting operating conditions of said internal combustion engine;

a crank angle sensor for generating a crank angle signal including a train of pulses which correspond respectively to rotational angles of a crankshaft of said internal combustion engine;

an intake camshaft and an exhaust camshaft for driving intake and exhaust valves, respectively, of said internal combustion engine in synchronization with the rotation of said crankshaft;

cam angle changing means mounted on at least one of said intake and exhaust camshafts for changing the phase of said at least one of said camshafts relative to said crankshaft;

a cam angle sensor mounted on said at least one camshaft whose phase relative to said crankshaft is changed by said cam angle changing means, for generating a cam angle signal for identifying respective cylinders of said internal combustion engine and for detecting a cam angle of said at least one camshaft whose relative phase to said crankshaft is changed by said cam angle changing means;

reference crank angle position calculation means for calculating reference crank angle positions based on said crank angle position signal;

cam angle calculation means for calculating said cam angle based on said crank angle signal and said cam angle signal; and cam angle control means for controlling said cam angle changing means based on the operating conditions of said internal combustion engine and said cam angle calculated by said cam angle calculation means in such a manner that the phase of said camshaft relative to said crankshaft is controlled so as to coincide with a target cam angle which corresponds to the operating conditions of said internal combustion engine;

wherein said cam angle calculation means calculates said cam angle by counting the number of pulses of said crank angle signal; and wherein said cam angle control means comprises cam angle learning means for learning reference positions of said cam angle, wherein when said cam angle changing means is out of operation, said cam angle learning means learns an angular deviation between said cam angle calculated by said cam angle calculation means and a designed value of said crank angle position.

2. The valve timing control apparatus for an internal combustion engine according to claim 1, wherein said cam angle calculation means comprises storage means for storing crank angle positions of said crankshaft, and wherein when said cam angle signal has been detected within a duration from detection timing of the last pulse of said crank angle signal to detection timing of the current pulse thereof, a crank angle position at the detection timing of the current pulse is stored in said storage means so that said cam angle is calculated by using said crank angle position thus stored.

3. The valve timing control apparatus for an internal combustion engine according to claim 1, wherein when said cam angle signal is detected between successive pulses of said crank angle signal, said cam angle calculation means calculates said cam angle by using a time measured between said successive pulses and a time measured between said cam angle signal and said crank angle signal.

4. The valve timing control apparatus for an internal combustion engine according to claim 1, wherein said cam angle control means comprises cam angle learning means for learning reference positions of said cam angle, wherein when said cam angle changing means is out of operation, said cam angle learning means learns a crank angle position corresponding to said cam angle calculated by said cam angle calculation means.

5. The valve timing control apparatus for an internal combustion engine according to claim 1, wherein said cam angle control means controls said cam angle changing means by using the reference positions learned by said cam angle learning means.

6. A valve timing control apparatus for an internal combustion engine comprising:

sensor means for detecting operating conditions of said internal combustion engine;

a crank angle sensor for generating a crank angle signal including a train of pulses which correspond respectively to rotational angles of a crankshaft of said internal combustion engine;

an intake camshaft and an exhaust camshaft for driving intake and exhaust valves, respectively, of said internal combustion engine in synchronization with the rotation of said crankshaft;

cam angle changing means mounted on at least one of said intake and exhaust camshafts for changing the phase of said at least one of said camshafts relative to said crankshaft;

a cam angle sensor mounted on said at least one camshaft whose phase relative to said crankshaft is changed by said cam angle changing means, for generating a cam angle signal for identifying respective cylinders of said internal combustion engine and for detecting a cam angle of said at least one camshaft whose relative phase to said crankshaft is changed by said cam angle changing means;

reference crank angle position calculation means for calculating reference crank angle positions based on said crank angle position signal;

cam angle calculation means for calculating said cam angle based on said crank angle signal and said cam angle signal; and cam angle control means for controlling said cam angle changing means based on the operating conditions of said internal combustion engine and said cam angle calculated by said cam angle calculation means in such a manner that the phase of said camshaft relative to said crankshaft is controlled so as to coincide with a target cam angle which corresponds to the operating conditions of said internal combustion engine;

wherein said cam angle calculation means calculates said cam angle by counting the number of pulses of said crank angle signal; and wherein said cam angle control means comprises cam angle learning means for learning reference positions of said cam angle, wherein when said cam angle changing means is out of operation, said cam angle learning means learns a crank angle position corresponding to said cam angle calculated by said cam angle calculation means.

7. A valve timing control apparatus for an internal combustion engine comprising:

a crank angle sensor which generates a crank angle signal including a train of pulses which correspond, respectively, to rotational angles of a crankshaft;

a camshaft which drives an intake valve or an exhaust valve in synchronization with the rotation of said crankshaft;

a control circuit which changes the phase of said camshaft relative to said crankshaft, which generates a cam angle signal and detects a cam angle of said camshaft, which calculates said cam angle based on said crank angle signal and said cam angle signal, which detects operating conditions of said internal combustion engine, which controls said cam angle based on the operating conditions of said internal combustion engine and said calculated cam angle so that the phase of said camshaft relative to said crankshaft coincides with a target cam angle which corresponds to the operating conditions of said internal combustion engine, wherein said control circuit calculates said cam angle by counting the number of pulses of said crank angle signal, wherein said control circuit detects reference positions of said cam angle, and wherein when said cam angle changing means is out of operation said control circuit detects an angular deviation between said calculated cam angle and a designed value of said crank angle position.

8. The valve timing control apparatus for an internal combustion engine according to claim 7, wherein said control circuit calculates reference crank angle positions based on said crank angle position signal.

9. The valve timing control apparatus for an internal combustion engine according to claim 7, wherein said control circuit comprises a memory which stores crank angle positions of said crankshaft, and wherein when said cam angle signal has been detected within a duration from detection timing of the last pulse of said crank angle signal to detection timing of the current pulse thereof, a crank angle position at the detection timing of the current pulse is stored in said memory so that said cam angle is calculated by using said crank angle position thus stored.

10. The valve timing control apparatus for an internal combustion engine according to claim 7, wherein when said cam angle signal is detected between successive pulses of said crank angle signal, said control circuit calculates said cam angle by using a time measured between said successive pulses and a time measured between said cam angle signal and said crank angle signal.

11. The valve timing control apparatus for an internal combustion engine according to claim 7, wherein said control circuit detects reference positions of said cam angle, and wherein under a predetermined condition said control circuit detects a crank angle position corresponding to said calculated cam angle.

12. The valve timing control apparatus for an internal combustion engine according to claim 7, wherein said control circuit controls said cam angle by using the reference positions detected by said control circuit.

* * * * *